US006790285B2

(12) United States Patent
Matsumoto

(10) Patent No.: US 6,790,285 B2
(45) Date of Patent: Sep. 14, 2004

(54) ELECTROSTATIC COATER WITH POWER TRANSMISSION FREQUENCY ADJUSTER

(75) Inventor: Takuya Matsumoto, Tokyo (JP)

(73) Assignee: Anest Iwata Corporation, Kanagawa (JP)

( * ) Notice: Subject to any disclaimer, the term of this patent is extended or adjusted under 35 U.S.C. 154(b) by 134 days.

(21) Appl. No.: 10/070,924

(22) PCT Filed: Jul. 17, 2001

(86) PCT No.: PCT/JP01/06175

§ 371 (c)(1),
(2), (4) Date: Mar. 13, 2002

(87) PCT Pub. No.: WO02/07895

PCT Pub. Date: Jan. 31, 2002

(65) Prior Publication Data

US 2002/0148405 A1 Oct. 17, 2002

(30) Foreign Application Priority Data

Jul. 21, 2000 (JP) ..... 2000-219974

(51) Int. Cl.[7] ..... B05B 5/053

(52) U.S. Cl. ..... 118/707; 118/712; 118/629; 118/523; 239/691; 363/61; 363/60; 363/59

(58) Field of Search ..... 118/663, 621, 118/629, 627, 712, 708, 707; 363/59, 60, 61; 239/691

(56) References Cited

U.S. PATENT DOCUMENTS 5,566,042 A 10/1996 Perkins et al.
5,703,770 A 12/1997 Burtin et al.
5,939,993 A 8/1999 Burtin et al.

FOREIGN PATENT DOCUMENTS

| | | |
|---|---|---|
| JP | 4-161262 | 6/1992 |
| JP | 10-128170 | 5/1998 |
| JP | 10-202151 | 8/1998 |

*Primary Examiner*—Richard Crispino
*Assistant Examiner*—George R. Koch, III
(74) *Attorney, Agent, or Firm*—Wenderoth, Lind & Ponack L.L.P.

(57) ABSTRACT

The present invention provides an electrostatic painting device with a transmission frequency adjustment device for automatically adjusting a transmission frequency in such a manner that the consumed current flowing in a high voltage booster circuit does not exceed a prescribed value. The present electrostatic painting device comprises a high-voltage booster circuit 201 provided in an electrostatic spray gun 2 to rectify a high frequency low voltage and generate a DC high voltage for electrostatic painting, a high-frequency low-voltage generator 1 provided independently of the electrostatic spray gun to generate a high frequency low voltage, a low-voltage cable 3 for connecting the high-frequency low-voltage to the high-voltage booster circuit, a current sensor 111 for detecting a current value corresponding to the intrinsic consumed current at the high-voltage booster circuit, and a frequency controller 107 and 112 for adjusting a frequency of a high frequency low voltage in such a manner that a current value detected by the current sensor does not exceed a predetermined value.

14 Claims, 5 Drawing Sheets

ELECTROSTATIC COATER WITH POWER TRANSMISSION FREQUENCY ADJUSTER

FIELD OF THE INVENTION

The present invention relates to an electrostatic coater (or painting device) and, in particular, to adjustment of frequency of a high-frequency low voltage supplied to an electrostatic painting device with a high-voltage booster circuit.

BACKGROUND OF THE INVENTION

As is also disclosed in Japanese Patent Application Public-disclosure No. 10-128170, an internal booster-type electrostatic spray gun incorporating a high-voltage booster circuit has been developed as an electrostatic painting device. Such an electrostatic painting device, as is schematically described in FIG. 1, consists of a high-frequency low-voltage generator 1, an electrostatic spray gun (electrostatic painting device body) 2, a low-voltage cable 3, an air supplier (which is not shown) and a paint material supplier (which is not shown). A high-voltage booster circuit 201 comprises a transformer 202, a multiple voltage rectifier circuit 203, a resistor 204 and an output terminal 205. The high-frequency low-voltage generator 1 converts a voltage from a commercial alternating-current power supply to a DC voltage of 12V via a rectifier 101 and DC-DC converter 102. The thus obtained DC voltage is supplied to the intermediate point of the primary side coil of the transformer 202 via a line 103 and low-voltage cable 3. The ends of the primary side coil are connected to the collectors of transistors 104 and 105, respectively, via the low-voltage cable 3, and their emitters are grounded by a common line 106. From an oscillation control circuit 107 to the bases of the transistors 104 and 105 are provided driving signals which are in 180-degree phase shift with each other, whereby the transistors 104 and 105 are turned on alternately at frequencies of the driving signals. The multiple voltage rectifier circuit 203, resistor 204 and output terminal 205 are connected to the secondary side coil of the transformer 202. The transformer 202 boosts the primary side voltage by a dozen times, which is further boosted by the multiple voltage rectifier circuit 203 (by ten times in this example) to obtain a DC voltage of −40 kv ~−90 kv.

The high-voltage booster circuit incorporated in the internal booster-type spray gun has an intrinsic parallel resonance frequency (frequency at which a consumed current becomes minimum: hereafter referred to as an anti-resonant frequency) attributable to its unique hardware structure, and when a voltage of such an anti-resonant frequency is supplied to a high-voltage booster circuit, power can be converted to high voltages most efficiently. In other words, when a voltage of an anti-resonant frequency is supplied, a current consumed at a high-voltage booster circuit is small, whereby the life of a transformer can be maximized while a load to be caused on the spray gun can be minimized. Further, as it is possible to generate a maximum voltage, efficient utilization of a voltage becomes viable.

FIG. 2 is a graph representing a change in current I consumed by a high-voltage booster circuit of an electrostatic spray gun when frequency f of an alternating-current low voltage sent from a high-frequency low-voltage generator to the high-voltage booster circuit is varied, and representing a change in boosted negative DC voltage V. As can be seen from FIG. 2, the DC voltage V does not change much in the neighborhood of the anti-resonant frequency, whereas the current I changes significantly. In this example, when the device is driven at frequencies at which the consumed current I exceeds approximately 1 A, the transformer is likely to be damaged by heat. Therefore, it is ideal that the device be driven at a driving frequency $f_0$ at which the consumed current I becomes a minimum, that is, about 0.2 A.

Dispersion arising during the manufacture of high voltage booster circuits (for example, dispersion in electronic components of circuits) sometimes results in disadvantageous fluctuation of an intrinsic anti-resonant frequency of a high-voltage booster circuit. Further, when voltage supply from a high-frequency low voltage generator shifts from a high-voltage booster circuit for generating a voltage of, for example, −40 kv to a high-voltage booster circuit for generating a voltage of, for example, −90 kv, an optimum transmission frequency cannot be specified. Still further, when a technical specification of a high-voltage booster circuit per se is changed, for example, a transformer thereof is improved or modified with a view to cost reduction, etc., an anti-resonant frequency specific to the high-voltage booster circuit also changes.

If a high frequency low voltage whose frequency does not coincide with an anti-resonant frequency specific to a high voltage booster circuit is supplied to the high voltage booster circuit, an excess current flows into a transformer of the high voltage booster circuit to cause failure, and a rated output is not generated. Therefore, when an intrinsic anti-resonant frequency fluctuates beyond the referential scope as a result of dispersion arising during manufacture of a high-voltage booster circuit, an electrostatic spray gun incorporating the high voltage booster circuit is considered to be defective and thus, productivity substantially declines.

On the other hand, a volume for adjusting a frequency may be attached to the oscillation control circuit 107 of the high frequency low voltage generator 1 indicated in FIG. 1 to initialize an oscillation frequency at the time of assembly of the high frequency low voltage generator 1. For example, a transmission frequency is set to be about $f_x$, in the case of a high voltage booster circuit cartridge for −60 kv (natural anti-resonant frequency=$f_x$), whereas a transmission frequency is set to be about $f_y$ in the case of a high voltage booster circuit cartridge for −40 kv (natural anti-resonant frequency=fy). When anti-resonant frequencies specific to high voltage booster circuits disperse, an ammeter is connected to the line 103 of the high frequency low voltage generator 1. A volume is adjusted by monitoring a current value read by the ammeter to set, as an intrinsic anti-resonant frequency, a frequency at which the current value becomes minimum. However, initialization or resetting of a frequency while monitoring an ammeter can be troublesome.

Given the aforementioned problems of the prior art, it is an object of the present invention to provide an electrostatic painting device with a transmission frequency adjustment device which can automatically adjust a transmission frequency such that a consumed current running in the high voltage booster circuit does not exceed a certain value.

SUMMARY OF THE INVENTION

An electrostatic painting device provided with a transmission frequency adjustment device of the present invention comprises a high voltage booster circuit provided inside the body of the electrostatic painting device to rectify a high frequency low voltage and generate a DC high voltage for electrostatic painting, a high frequency low voltage generator provided independent of the body of the electrostatic painting device to generate a high frequency low voltage, a low voltage cable connecting the high frequency low voltage generator to the high voltage booster circuit, current sensor for detecting a current value corresponding to a value of an intrinsic consumed current at the high voltage booster circuit, and a frequency control device for adjusting a frequency of a high frequency low voltage such that the value of the current detected by the current sensor does not exceed a certain value.

According to an embodiment of the present invention, the frequency control device exercises control for determining a driving frequency of the high voltage booster circuit such that a value of the current detected by the current sensor becomes a minimum value. The current sensor is installed in the high frequency low voltage generator to detect a current guided to the low voltage cable. The frequency control device can operate either when a power switch of the electrostatic painting device is closed or at the set times. The electrostatic painting device is further provided with an abnormality indication device for indicating an abnormality when the value of the current detected by the current sensor exceeds a predetermined value. The frequency control device adjusts a frequency of a high frequency low voltage when an abnormality is indicated.

DETAILED DESCRIPTION OF THE PREFERRED EMBODIMENT

Figure 1:
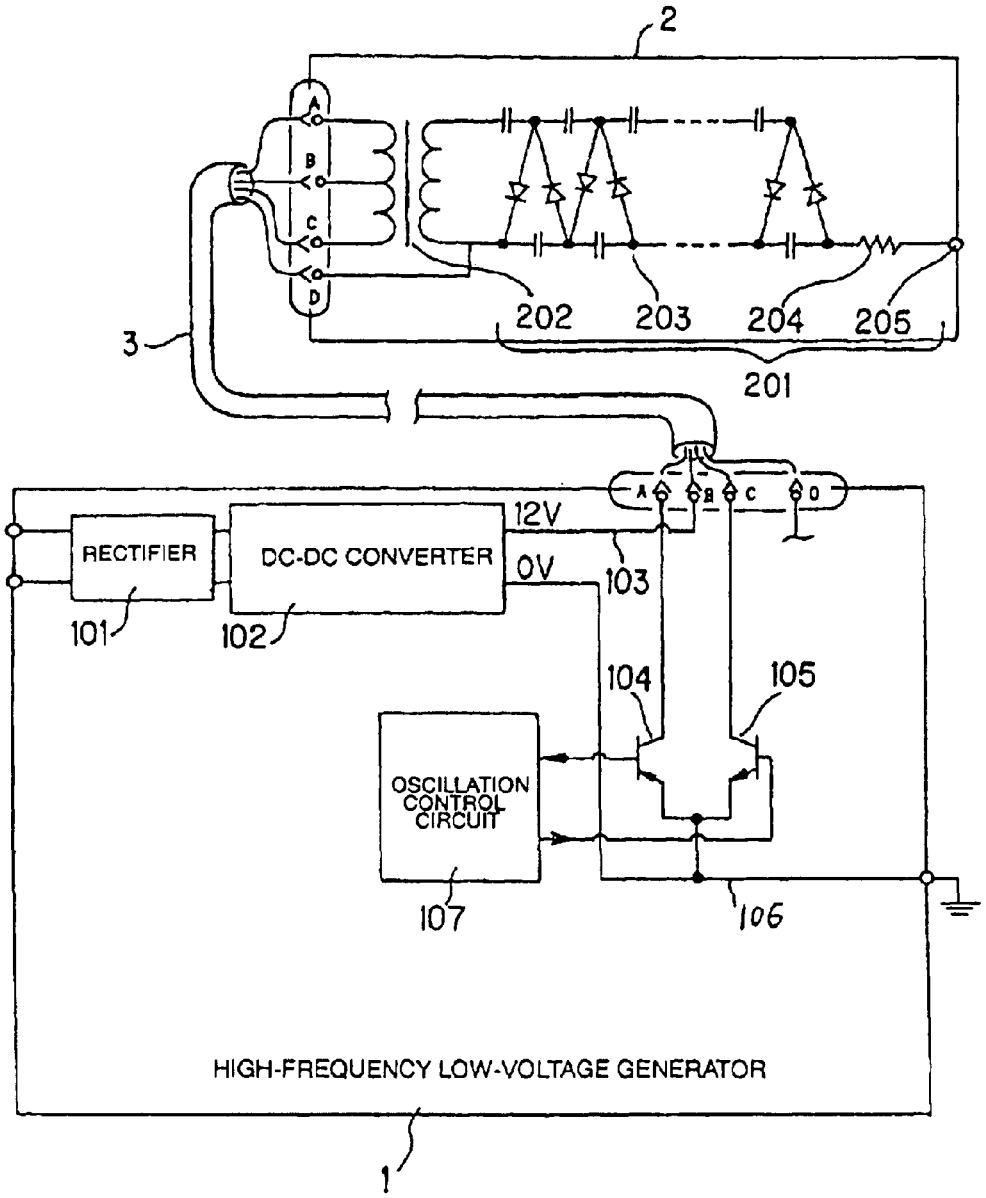
PRIOR ART Fig. 1
FIG. 1 is a schematic system diagram of a conventional electrostatic painting device.
Figure 2:
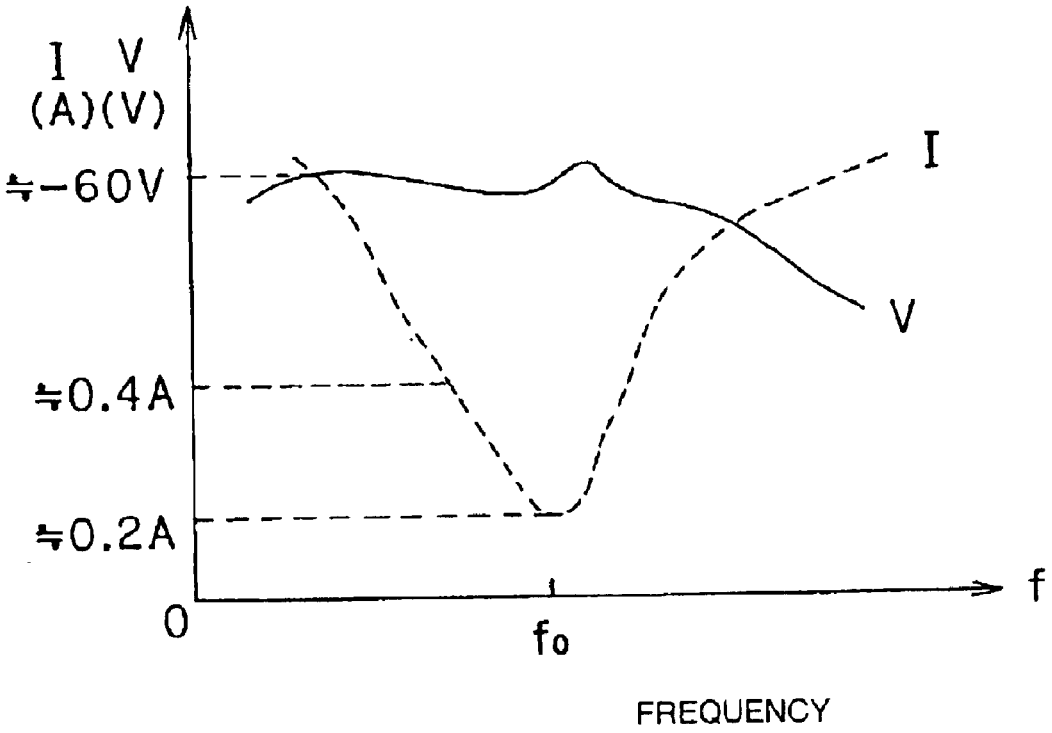
FIG. 2 is a graph representing a change in the relationship between a frequency and a consumed current and a change in the relationship between a frequency and a generated DC voltage.
Figure 3:
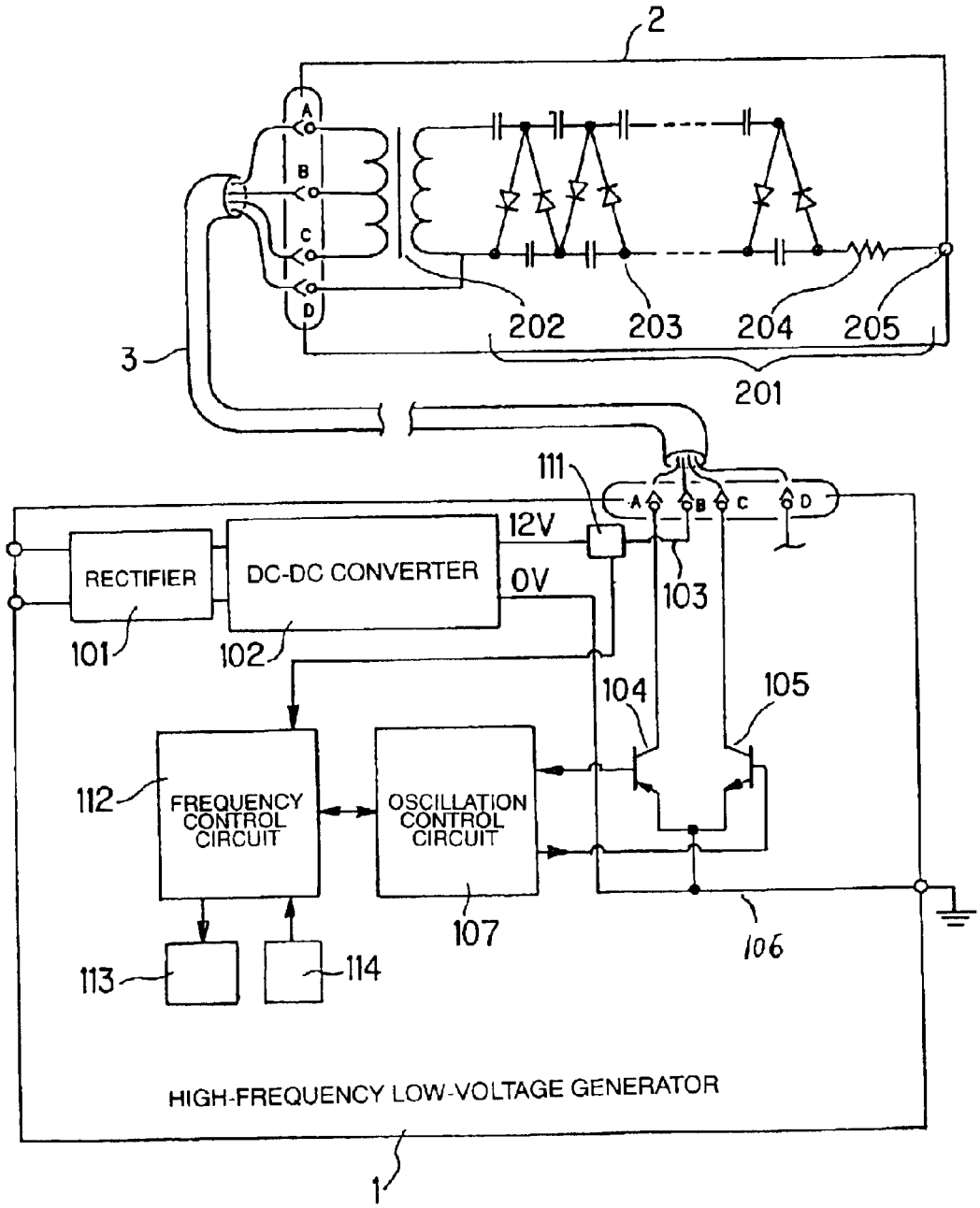
FIG. 3 is a schematic system diagram indicating an embodiment of an electrostatic painting device provided with a transmission frequency adjustment device of the present invention.

FIG. 3 is a schematic system diagram indicating an electrostatic painting device provided with a transmission frequency adjustment device of the present invention. In FIGS. 1 and 3, like numerals denote like components. In the high frequency low voltage generator 1 of FIG. 3, the current detection sensor 111 is connected to the line 103 applying a 12V output from the DC-DC converter 102 to the low voltage cable 3. The current detection sensor 111 may be a search coil, etc., and anything can be used as the current detection sensor 111 as long as it can detect a value proportional to the value of the current flowing in the line 103. A current flowing in the line 103 is the current on the primary side of the transformer 202 of the high voltage booster circuit 201, and corresponds to the current consumed by the high voltage booster circuit 201 (i.e., the intrinsic consumed current). The value of the current detected by the current detection sensor 111 is converted to a digital signal by an A/D (analog/digital) converter to be output to the frequency control circuit 112. The frequency control circuit 112 stores a frequency adjusting program, in accordance with which a signal of an input current value is processed. If it transpires that the thus processed signal exceeds a threshold, a warning indication signal is output to a warning indication device 113. In response to the warning indication signal, the warning indication device 113 turns on a warning lamp and/or sounds an alarm. The frequency control circuit 112 adjusts (increases/decreases) an oscillation frequency of the oscillation control circuit 107 in accordance with the frequency adjusting program. Further, the search start button 114 is connected to the frequency control circuit 112, and when the search start button 114 is operated, a predetermined subroutine of the frequency adjusting program starts to perform an operation for searching for an optimum driving frequency.

Figure 4:
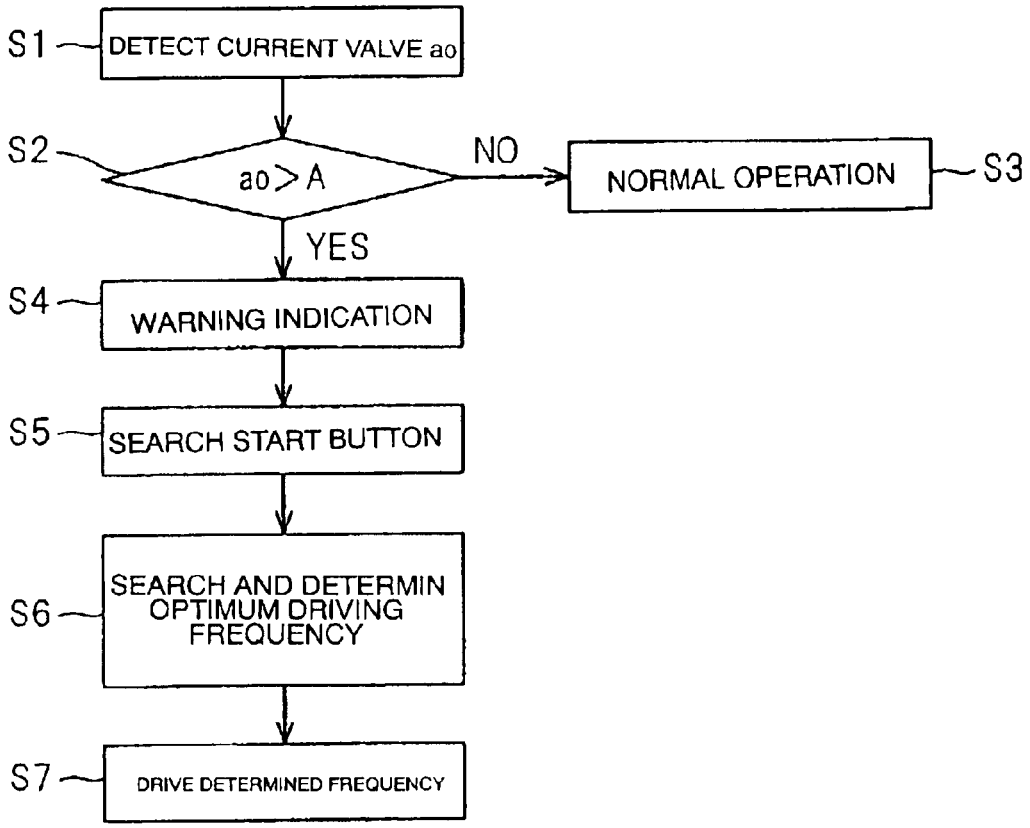
FIG. 4 is a flow chart depicting an embodiment of a transmission frequency adjusting operation of the present invention.

FIG. 4 is a flow chart depicting a processing operation performed in accordance with the frequency adjusting program stored in the frequency control circuit 112. At step S1, the frequency control circuit 112 receives a current value $a_0$ detected by the current detection sensor 111. Next, at step S2, the current value $a_0$ is compared with a threshold value A representing a safe driving boundary of the frequency. If the current value $a_0$ is less than the threshold value A, it is determined that the current oscillation frequency of the oscillation control circuit 107 is adequate and the processing operation proceeds to step S3, where the high voltage booster circuit 201 is driven at the current oscillation frequency to operate the electrostatic spray gun. On the other hand, if it is determined at step S2 that the current value $a_0$ has exceeded the threshold value A, the processing operation proceeds to step S4, where the oscillation control circuit 107 outputs a warning signal to the warning indication device 113 to indicate a warning. Next, the processing operation proceeds to step S5, where an operator finds an abnormality of a driving frequency from the warning indication and presses the search start button 114 to output a search start signal to the frequency control circuit 112. The processing operation further proceeds to step S6, where a frequency adjusting program receives a search start signal and starts an operation of searching for an optimum driving frequency.

Figure 5:
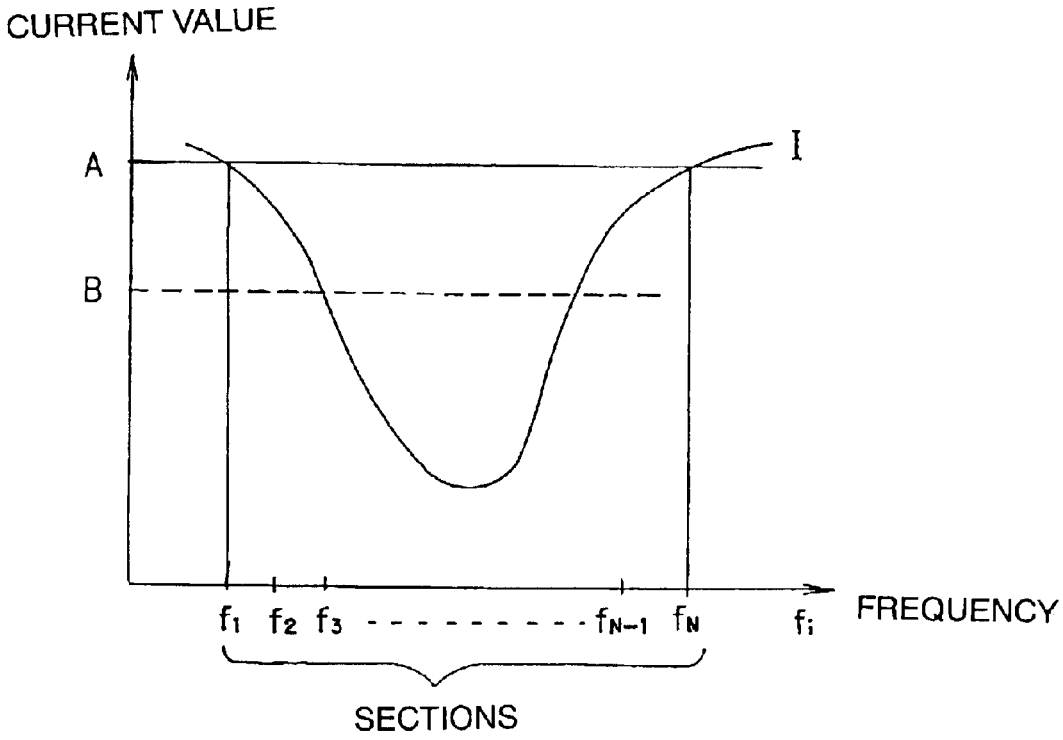
FIG. 5 is a graph representing a mode of an operation for searching an optimum driving frequency depicted in FIG. 4.

The operation of searching for an optimum driving frequency is performed at step S6 as follows. As is indicated in FIG. 5, a frequency band within the range of search is divided into a plurality of sections N sections in this example) to obtain a plurality of driving frequencies fi (i=1, 2, 3 . . . N; $f_1<f_2$), and the high voltage booster circuit 201 is driven successively at the thus obtained different driving frequencies to find current values $a_i$(i=1, 2, 3 . . . N) corresponding to the respective driving frequencies fi and store the current values. Next, the smallest one of the stored current values $a_i$ is selected and the driving frequency fi corresponding to the thus selected smallest current value $a_i$ is determined to be an optimum driving frequency. The processing operation then proceeds to step S7, where the high voltage booster circuit 201 is driven at the thus chosen optimum driving frequency fi to operate the electrostatic spray gun.

The above embodiment employs a manner of obtaining detected current values corresponding to a plurality of driving frequencies to determine an optimum driving frequency. However, the present invention is not limited to the above manner, and other known methods for determining an optimum driving frequency, such as a method for estimating an optimum driving frequency from a driving frequency—consumed current characteristic curve, at which a current value becomes the smallest, etc., may be employed. Further, although in the above embodiment a driving frequency at which a current value becomes the smallest is determined, frequencies corresponding to detected current values not more than a predetermined value, for example, a threshold value B (B=0.6× the aforementioned threshold value A) may be determined to be driving frequencies.

Still further, a processing operation in accordance with the frequency adjusting program may be performed when a power switch of the high-frequency low-voltage generator 1 is closed, or at the times pre-set (i.e., pre-set time intervals) by the oscillation control circuit 107, or when the high voltage booster circuit 201 is exchanged, modified, etc.

An electrostatic painting device of the present invention is designed such that an optimum frequency at which a minimum consumed current value specific to a high-voltage booster circuit incorporated in the electrostatic painting device or permissible consumed current value is obtained can be automatically generated at a high-frequency low-voltage generator. Therefore, frequencies affected by dispersion arising during manufacture of high voltage booster circuits can be easily adjusted to be an optimum frequency to compensate for manufacturing dispersion. Further, if a new spray gun provided with a high voltage booster circuit of a different voltage specification is employed at a job site, the same high frequency low voltage generator as used for the old spray gun can be employed as it can readily adjust the frequency of the high voltage booster circuit of the new spray gun to an optimum frequency. Thus, an electrostatic painting device of the present invention is always driven at an optimum frequency, which prolongs a life of the apparatus and improves quality of products manufactured by the apparatus.

In the present invention, an electrostatic spray gun for atomizing a painting material by compressed air and charging particles of the material is described as an embodiment of an optimum electrostatic painting device. However, the present invention is in no way restricted by the above embodiment and is applicable to, for example, an electrostatic rotary atomization type painting device for discharging a painting material in the form of a thin film from the rim of a cup rotating at a high speed by means of a centrifugal force of the cup and atomizing the material in the form of a thin film by means of repulsion of static electricity instead of utilizing compressed air.

The embodiment described above is given as an illustrative example only. It will be readily appreciated that many deviations may be made from the specific embodiment disclosed in the specification without departing from the invention. Accordingly, the scope of the invention is to be determined by the claims.

What is claimed is:

1. An electrostatic painting device comprising:

a painting device body;

a high-voltage booster circuit in said painting device body, said high-voltage booster circuit being operable to receive a high-frequency low voltage and to rectify the high-frequency low voltage and generate a DC high voltage for electrostatic painting;

a high-frequency low-voltage generator independent of said painting device body, said high-frequency low-voltage generator being operable to generate the high-frequency low voltage;

a low-voltage cable connecting said high-frequency low-voltage generator to said high-voltage booster circuit;

a current sensor for detecting a current value of an intrinsic consumed current at said high-voltage booster circuit; and a frequency control device for adjusting a frequency of the high-frequency low voltage such that the current value detected by said current sensor does not exceed a prescribed value.

2. The electrostatic painting device of claim 1, wherein said frequency control device is operable to adjust the frequency of the high-frequency low voltage so that the current value detected by said current sensor is a smallest possible current value.

3. The electrostatic painting device of claim 2, wherein said current sensor is arranged in said high-frequency low-voltage generator to detect the current value of a current supplied to said low-voltage cable by said high-frequency low-voltage generator.

4. The electrostatic painting device of claim 2, wherein said frequency control device is operable to adjust the frequency of the high-frequency low voltage when a power switch of said high-frequency low-voltage generator is closed.

5. The electrostatic painting device of claim 2, wherein said frequency control device is operable to adjust the frequency of the high-frequency low voltage at pre-set time intervals.

6. The electrostatic painting device of claim 2, further comprising an abnormality indication device for indicating an abnormal state when the current value detected by said current sensor exceeds a predetermined current value, said frequency control device being operable to adjust the frequency of the high-frequency low voltage when the abnormal state is indicated by said abnormality indication device.

7. The electrostatic painting device of claim 1, wherein said current sensor is arranged in said high-frequency low-voltage generator to detect the current value of a current supplied to said low-voltage cable by said high-frequency low-voltage generator.

8. The electrostatic painting device of claim 7, further comprising an abnormality indication device for indicating an abnormal state when the current value detected by said current sensor exceeds a predetermined current value, said frequency control device being operable to adjust the frequency of the high-frequency low voltage when the abnormal state is indicated by said abnormality indication device.

9. The electrostatic painting device of claim 1, wherein said frequency control device is operable to adjust the frequency of the high-frequency low voltage when a power switch of said high-frequency low-voltage generator is closed.

10. The electrostatic painting device of claim 9, further comprising an abnormality indication device for indicating an abnormal state when the current value detected by said current sensor exceeds a predetermined current value, said frequency control device being operable to adjust the frequency of the high-frequency low voltage when the abnormal state is indicated by said abnormality indication device.

11. The electrostatic painting device of claim 1, wherein said frequency control device is operable to adjust the frequency of the high-frequency low voltage at pre-set time intervals.

12. The electrostatic painting device of claim 11, further comprising an abnormality indication device for indicating an abnormal state when the current value detected by said current sensor exceeds a predetermined current value, said frequency control device being operable to adjust the frequency of the high-frequency low voltage when the abnormal state is indicated by said abnormality indication device.

13. The electrostatic painting device of claim 1, further comprising an abnormality indication device for indicating an abnormal state when the current value detected by said current sensor exceeds a predetermined current value, said frequency control device being operable to adjust the frequency of the high-frequency low voltage when the abnormal state is indicated by said abnormality indication device.

14. The electrostatic painting device of claim 1, wherein said high-voltage booster circuit includes a primary winding and a secondary winding, said low-voltage cable connecting said high-frequency low-voltage generator to said primary winding of said high-voltage booster so that the intrinsic consumed current flows through said primary winding of said high-voltage booster circuit via said low-voltage cable.

* * * * *